US011725318B2

(12) United States Patent
Leroy

(10) Patent No.: US 11,725,318 B2
(45) Date of Patent: Aug. 15, 2023

(54) METHOD OF FORMING AN ANNULAR TEXTILE PREFORM BY NEEDLING A HELICAL FIBER SHEET, AND A MACHINE FOR PERFORMING SUCH A METHOD

(71) Applicant: SAFRAN LANDING SYSTEMS, Velizy-Villacoublay (FR)

(72) Inventor: Hugues Leroy, Villeurbanne (FR)

(73) Assignee: SAFRAN LANDING SYSTEMS, Velizy-Villacoublay (FR)

( * ) Notice: Subject to any disclaimer, the term of this patent is extended or adjusted under 35 U.S.C. 154(b) by 74 days.

(21) Appl. No.: 17/455,129

(22) Filed: Nov. 16, 2021

(65) Prior Publication Data

US 2022/0074095 A1 Mar. 10, 2022

Related U.S. Application Data

(62) Division of application No. 16/110,143, filed on Aug. 23, 2018, now Pat. No. 11,193,223.

(30) Foreign Application Priority Data

Sep. 1, 2017 (FR) ..... 17 58088

(51) Int. Cl.
*D04H 18/02* (2012.01)

(52) U.S. Cl.
CPC ..... *D04H 18/02* (2013.01); *D10B 2505/02* (2013.01)

(58) Field of Classification Search
CPC ..... D04H 18/02; D04H 1/04; D04H 1/00; D04H 1/46; D04H 3/102; D04H 3/105; D04H 5/02; D04H 13/005; B65H 5/18; B65H 49/28; B65H 20/24; B65H 20/00; B65H 16/00; D10B 2505/02
USPC ..... 28/107
See application file for complete search history.

(56) References Cited

U.S. PATENT DOCUMENTS 5,546,880 A * 8/1996 Ronyak ..... B32B 18/00 188/250 C
6,009,605 A * 1/2000 Olry ..... D04H 3/105 28/107
6,183,583 B1 2/2001 Duval
6,363,593 B1 * 4/2002 Duval ..... D04H 18/00 28/107

(Continued)

FOREIGN PATENT DOCUMENTS

EP 1 397 544 A1 3/2004
EP 2 339 055 A1 6/2011
WO WO 02/068747 A1 9/2002

OTHER PUBLICATIONS

French Preliminary Search Report issued in French Application 17 58088 dated Mar. 27, 2018 (w/English Translation of Categories of Cited Documents).

*Primary Examiner* — Nathan E Durham
*Assistant Examiner* — Abby M Spatz
(74) *Attorney, Agent, or Firm* — Oblon, McClelland, Maier & Neustadt, L.L.P.

(57) ABSTRACT

A machine for forming an annular textile preform includes: a horizontal sheet-forming turntable for forming a helical fiber; a horizontal intermediate turntable positioned under the sheet-forming turntable; a horizontal intermediate unwinder positioned on the intermediate; a final horizontal unwinder positioned under the intermediate unwinder; and a horizontal preform-forming turntable positioned under the final unwinder.

3 Claims, 1 Drawing Sheet

(56) References Cited

U.S. PATENT DOCUMENTS

| | | | | |
|---|---|---|---|---|
| 9,090,050 | B2 * | 7/2015 | Gill | B21C 49/00 |
| 2011/0154628 | A1 * | 6/2011 | Vincent | D04H 18/02 28/107 |
| 2015/0273811 | A1 | 10/2015 | Le Costaouez | |

* cited by examiner

METHOD OF FORMING AN ANNULAR TEXTILE PREFORM BY NEEDLING A HELICAL FIBER SHEET, AND A MACHINE FOR PERFORMING SUCH A METHOD

CROSS-REFERENCE TO RELATED APPLICATIONS

This application is a division of U.S. application Ser. No. 16/110,143 filed Aug. 23, 2018, the entire contents of which is incorporated herein by reference. U.S. application Ser. No. 16/110,143 claims the benefit of priority from prior French Application No. 17 58088 filed Sep. 1, 2017.

BACKGROUND OF THE INVENTION

The present invention relates to the general field of needling a helical fiber sheet in order to make an annular textile preform.

It is known to use a circular type needling machine to fabricate annular textile preforms that are to constitute the fiber reinforcement of annular parts made of composite material, in particular brake disks, such as carbon/carbon (C/C) composite material disks for airplane brakes.

A circular needling machine generally comprises a horizontal annular turntable having a helical fiber sheet placed thereon, drive means (usually friction drive means) for driving the fiber sheet in rotation about the vertical axis of the turntable, and a needling device having a needling head extending over an angular sector of the turntable and driven to move vertically relative to the turntable. Reference may be made to Document WO 02/088451, which describes an embodiment of such a needling table.

In the context of industrializing the production of annular textile preform is, provision is generally made for the above-described needling machine to be associated with a table for forming a helical fiber sheet (or spiral sheet). In practice, the sheet-forming table is positioned above the needling table and feeds it continuously with helical fiber sheet. However, although the sheet-forming table operates continuously, the needling table draws on the helical fiber sheet in discontinuous manner. Specifically, the needling table stops being fed with sheet after the sheet has been cut, while performing finishing needling, during operations of inspecting the preform, and while removing the preform that has been made, prior to restarting a full cycle. The continuous operation of the sheet-following machine is thus in conflict with the discontinuous operation of the needling table.

OBJECT AND SUMMARY OF THE INVENTION

A main object of the present invention is thus to propose a method of forming an annular textile preform by needling a helical fiber sheet, which method does not present the above-mentioned drawbacks and can accommodate the differing manners of operation of the sheet-forming table and of the needling table.

This object is achieved by a method of forming an annular textile preform by needling a helical fiber sheet, the method comprising successively unwinding a helical fiber sheet from a horizontal sheet-forming turntable driven at a constant and predefined speed of rotation $N_{FS}$ onto a horizontal intermediate unwinder driven at a speed of rotation $N_{DI}$ and positioned on a horizontal intermediate turntable driven at a speed of rotation $N_{FI}$, unwinding the helical fiber sheet from the intermediate unwinder onto a final horizontal unwinder driven at a speed of rotation $N_{DF}$, and unwinding the fiber sheet from the final unwinder onto a horizontal preform-forming turntable driven at a variable and predefined speed of rotation $N_{FP}$ so as to be subjected to needling thereon, the speeds $N_{DI}$, $N_{FI}$, and $N_{DF}$ being controlled in such a manner that:

$N_{DF}$ is proportional to $N_{FP}$;

$N_{FI}=(N_{FS}-N_{DF})/2$; and $N_{DI}=(N_{FS}+N_{DF})/2$.

The invention is remarkable in that it proposes receiving and storing the helical fiber sheet that is produced continuously by the sheet-forming table on an intermediate unwinder. In particular, the invention makes it possible to store the sheet temporarily between the sheet-forming table and the needling table so as to mitigate the differing speeds of operation of those two tables. Thus, when the needling table needs to be stopped (e.g. in order to remove a finished preform), the helical fiber sheet that is being produced continuously by the sheet-forming table accumulates in superposed turns on the intermediate unwinder while waiting for a new cycle of the needling table to start. There is thus no need to stop the sheet-forming turntable while stopping the preform-forming turntable.

More precisely, with the speeds in, $N_{DI}$, $N_{FI}$, and $N_{DF}$ being controlled as defined according to the invention, each time the needling table is stopped, the intermediate turntable makes one complete turn for every two turns of sheet unwound from the sheet-forming table so as to store one turn of sheet on the intermediate unwinder and another turn of sheet wound in the same direction on the final unwinder.

The sheet-forming turntable and the preform-forming turntable advantageously have respective mean speeds that are equal.

Preferably, $N_{DF}=k\times N_{FP}$ in which $\underline{k}$ is a predetermined constant or variable factor corresponding to regulating the servocontrol of the quantity of helical fiber sheet in a regulator chute positioned between the final unwinder and the preform-forming turntable.

Also preferably, the method further comprises counting the number of turns of helical fiber sheet unwound onto the intermediate unwinder. This counting serves to manage stopping the sheet-forming machine in the event of reaching the (predetermined) maximum number of turns of sheet that can be stored on the intermediate unwinder, or conversely to manage stopping the needling machine the number of turns of sheet stored on the intermediate unwinder drops to zero.

Also preferably, needling of the helical fiber sheet is interrupted at the end of each cycle of forming an annular textile preform, in order to enable said preform to be removed.

The invention also provides a circular needling machine for performing the above defined method of forming an annular textile preform from a helical fiber sheet, the machine comprising a horizontal sheet-forming turntable for forming a helical fiber sheet and driven at a constant and predefined speed of rotation $N_{FS}$, a horizontal intermediate turntable positioned under the sheet-forming turntable and driven at a speed of rotation $N_{FI}$, a horizontal intermediate unwinder positioned on the intermediate turntable and driven at a speed of rotation $N_{DI}$, a final horizontal unwinder positioned under the intermediate unwinder and driven at a speed of rotation $N_{DF}$, and a horizontal preform-forming turntable positioned under the final unwinder and driven at a variable and predefined speed of rotation $N_{FP}$.

Preferably, the machine further comprises a regulator chute for regulating the unwinding of the fiber sheet and positioned between the final unwinder and the preform-forming turntable.

Each of the intermediate and final unwinders may comprise two curved circular conveyor portions arranged facing each other.

The preform-forming turntable may have a needling head driven with vertical reciprocating motion relative to the turntable.

BRIEF DESCRIPTION OF THE DRAWING

Other characteristics and advantages of the present invention appear from the following description made with reference to the accompanying drawing, which shows an implementation having no limiting character. In the figures.

DETAILED DESCRIPTION OF THE INVENTION

Figure 1:
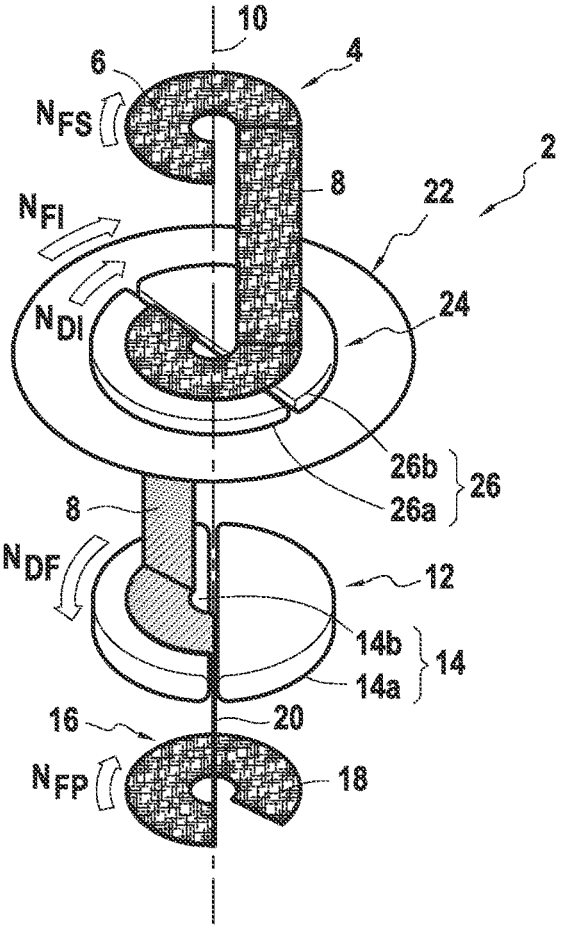
FIG. 1 is a diagrammatic view of a circular needling machine for performing the method of the invention for forming an annular textile preform.

FIG. 1 shows in a highly diagrammatic manner a circular needling machine 2 of the invention for forming an annular preform from a helical fiber sheet (or strip).

Typically, such a circular needling machine 2 comprises a sheet-forming table 4 that is to form a helical fiber sheet (e.g. by weaving). The sheet-forming table comprises in particular a horizontal sheet-forming turntable 6 having positioned thereon the fiber sheet 8 that is being formed.

The sheet-forming turntable 6 is caused to move in rotation about a vertical axis 10. Since forming the sheet is an operation that can be performed continuously at a constant speed, the sheet-forming turntable 6 is more specifically caused to move in rotation at a speed of rotation $N_{FS}$ that is constant and predefined.

The circular needling table 2 also has a final unwinder 12 situated under the sheet-forming table 4, the final unwinder typically serving to unwind the fiber sheet 8 as wound on the sheet-forming turntable 6 in order to take it to needling.

As described in greater detail in publication EP 2 339 055, the final unwinder 12 comprises a circular conveyor 14 for causing the fiber sheet 8 to rotate about the vertical axis 10. The circular conveyor 14 may advantageously be made up of two curved conveyor portions 14*a*, 14*b*, each of which is in the form of half a disk, which portions are placed facing each other (the straight edges of these conveyor portions being parallel and face to face). These curved conveyor portions are caused to rotate in a direction so as cause the fiber sheet 8 to perform one complete 360° turn about the vertical axis 10.

The circular conveyor 14 of the final unwinder 12 is controlled so as to cause the fiber sheet 8 to rotate about the vertical axis at a speed of rotation $N_{DF}$.

A needling table 16 is positioned under the final unwinder 12 for the purpose of performing circular needling of the fiber sheet 8 as unwound from the final unwinder.

The needling table 16 is known, e.g. from publication EP 2 339 055, and is therefore not described in detail. In brief, it comprises a horizontal preform-forming turntable 18 that receives the fiber sheet so as to move in rotation about the vertical axis 10 at a speed of rotation $N_{FP}$, which speed is adjustable.

During this rotation, the fiber sheet is subjected to needling by a needling head (not shown in FIG. 1) that extends over an angular sector of the sheet-forming turntable and that is driven relative thereto with reciprocating vertical motion.

As described in publication EP 2 339 055, it should be observed that the fiber sheet 8 as unwound from the circular conveyor 14 of the final unwinder is conveyed towards the preform-forming turntable 18 via a regulator chute 20 for regulating the unwinding of the sheet, which chute extends vertically between the final unwinder and the preform-forming turntable. The combined presence of a circular conveyor and of such a chute serves to deliver the fiber sheet without tension, the sheet being guided vertically towards the preform-forming turntable by using the chute.

By its very nature, the speed of rotation $N_{FP}$ of the preform-forming turntable 18 is not constant, since it is necessary, in particular at the end of each cycle of forming a preform by needling (after needling a predefined number of layers of fiber sheet), to stop the rotation of the turntable in order to remove the preform prior to beginning a new cycle. In particular, this speed of rotation $N_{FP}$, is a predefined value that is different from the speed of rotation $N_{FS}$ of the sheet-forming turntable 6.

According to the invention, provision is made to position a horizontal intermediate turntable 22 under the sheet-forming turntable 6, the intermediate turntable 22 being driven at a speed of rotation $N_{FI}$, and serving to provide temporary storage for a certain number of turns of fiber sheet 8 between the sheet-forming machine and the needling machine.

Furthermore, still according to the invention, a horizontal intermediate unwinder 24 is positioned on the intermediate turntable 22 and is driven at a speed of rotation $N_{DI}$. In the same manner as for the above-described final unwinder, the intermediate unwinder comprises a circular conveyor 26 that may be made up of two curved conveyor portions 26*a* and 26*b*, each of which is in the form of half a disk, which portions are arranged facing each other, with the direction of rotation of these curved portions being directed so as to cause the fiber sheet 8 to perform one complete 360° turn about the vertical axis 10.

The control of the circular needling machine of the invention is performed as follows, in particular concerning the speeds of rotation of its various component elements.

As mentioned above, the speeds $N_{FS}$ (of the sheet-forming turntable 6) and $N_{FP}$ (of the preform-forming turntable 18) are input variables that are known. Furthermore, these turntables 4 and 18 have respective mean speeds that are equal.

The speeds $N_{DI}$ (intermediate unwinder 24), $N_{FI}$ (intermediate turntable 22), and $N_{DF}$ (final unwinder 12) are controlled so as to satisfy the following control equations:

(a) $N_{DF}$ is proportional to $N_{FP}$;

(b) $N_{FI}=(N_{FS}-N_{DF})/2$; and (c) $N_{DI}=(N_{FS}+N_{DF})/2$.

Control equation (a) is a consequence of the presence of the regulator chute 20 for regulating the unwinding of the sheet between the final unwinder and the preform-forming turntable. More precisely, this equation is equivalent to: $N_{DF}=k\times N_{FP}$ in which $\underline{k}$ is a predetermined constant or variable factor corresponding to regulating the servocontrol of the quantity of helical fiber sheet in the regulator chute.

Control equations (b) and (c) serve in particular to store a plurality of turns of fiber sheet on the intermediate unwinder without stressing the fiber sheet between the intermediate unwinder and the final unwinder and without stressing the fiber sheet at the outlet from the sheet-forming turntable.

Figure 2:
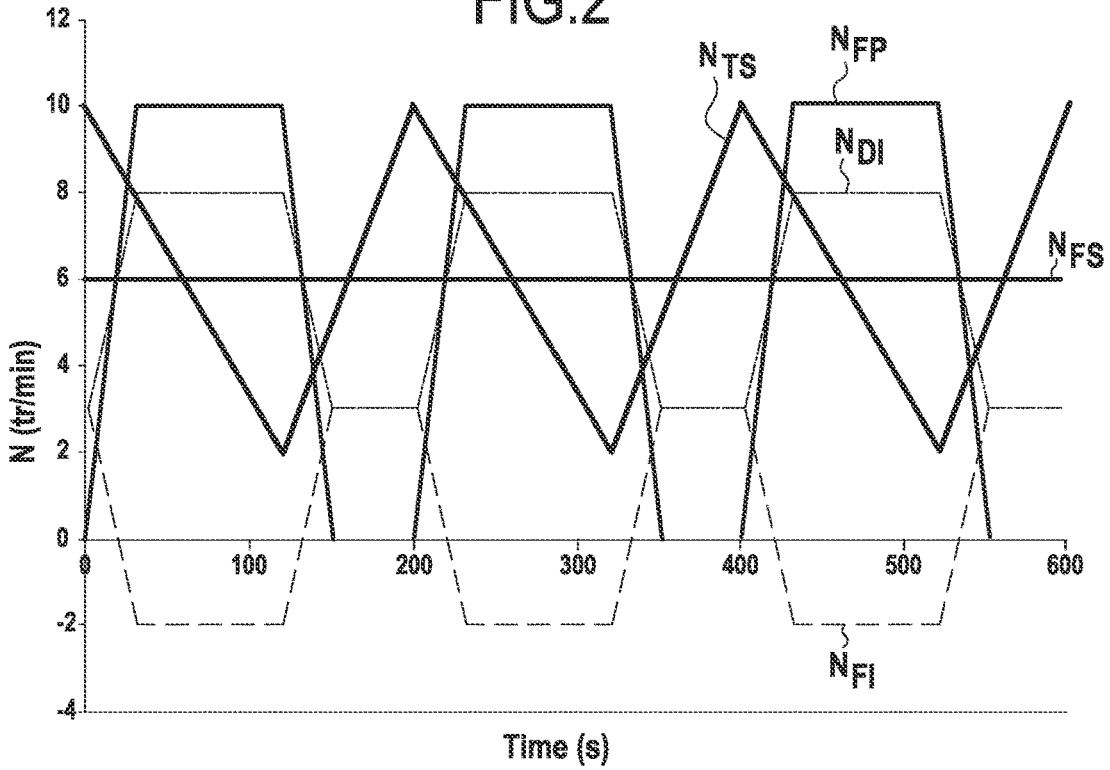
FIG. 2 is an example of cyclical timing charts showing the speeds of the various elements of the FIG. 1 machine.

FIG. 2 shows an example of controlling the speeds of the various elements of the circular needling machine of the invention.

More precisely, this figure shows an example of cyclical timing charts for speeds $N_{FP}$, $N_{FS}$, $N_{FI}$, and $N_{DI}$ that satisfy control equations (a) to (c) of the invention.

In this example, the speed $N_{FS}$ of the sheet-forming turntable is programmed to be constant and equal to 6 revolutions per minute (rpm). Likewise, the speed $N_{FP}$ of the preform-forming turntable is programmed to vary cyclically over the range 0 rpm to 10 rpm.

It should be observed that a zero speed $N_{FP}$ corresponds to time during which the preform-forming turntable is stopped in order to remove the preform once it has been finished and in order to reinitialize the machine before restarting for a new forming cycle. This stopping time is typically of the order of 50 seconds (s), approximately.

Starting from these predefined speeds $N_{FS}$ and $N_{FP}$, the operator controls the speeds $N_{DF}$, $N_{FI}$, and $N_{DI}$ so that they satisfy the above-mentioned equations (a) to (c). Cyclical timing charts for these speeds that satisfy these equations are shown in FIG. 2.

FIG. 2 also shows the cyclical timing chart $N_{TS}$ representing the number of turns of fiber sheet that accumulate on the intermediate unwinder. In this example, controlling the speeds $N_{DF}$, $N_{FI}$, and $N_{DI}$ makes it possible for there always to exist an accumulation of 2 to 10 turns of fiber sheet on the intermediate unwinder.

Thus, because of the presence of the intermediate unwinder, it is possible in particular to keep the speed $N_{FS}$ of the sheet-forming turntable constant in spite of the stops of the preform-forming turntable that are necessary for removing a preform at the end of each cycle and for restarting the turntable.

The invention claimed is:

1. A circular needling machine, the machine comprising:

a horizontal sheet-forming turntable for forming a helical fiber sheet and driven at a constant and predefined speed of rotation $N_{FS}$;

a horizontal intermediate turntable positioned under the sheet-forming turntable and driven at a speed of rotation $N_{FI}$;

a horizontal intermediate unwinder positioned on the intermediate turntable and driven at a speed of rotation $N_{DI}$;

a final horizontal unwinder positioned under the intermediate unwinder and driven at a speed of rotation $N_{DF}$; and a horizontal preform-forming turntable positioned under the final unwinder and driven at a variable and predefined speed of rotation $N_{FP}$.

2. The machine according to claim 1, further comprising a regulator chute for regulating unwinding of the helical fiber sheet and positioned between the final unwinder and the preform-forming turntable.

3. The machine according to claim 1, wherein each of the intermediate and final unwinders comprises two curved circular conveyor portions arranged facing each other.

* * * * *